US007644876B2

(12) United States Patent
Weis et al.

(10) Patent No.: US 7,644,876 B2
(45) Date of Patent: Jan. 12, 2010

(54) TURNING TOOL FOR TURNING A PLUMBING FITTING

(75) Inventors: Christoph Weis, Müllheim (DE); Hermann Grether, Müllheim (DE)

(73) Assignee: Neoperl GmbH, Mullheim (DE)

( * ) Notice: Subject to any disclaimer, the term of this patent is extended or adjusted under 35 U.S.C. 154(b) by 570 days.

(21) Appl. No.: 10/532,251

(22) PCT Filed: Aug. 25, 2003

(86) PCT No.: PCT/EP03/09387

§ 371 (c)(1),
(2), (4) Date: Apr. 21, 2005

(87) PCT Pub. No.: WO2004/038113

PCT Pub. Date: May 6, 2004

(65) Prior Publication Data

US 2005/0253378 A1 Nov. 17, 2005

(30) Foreign Application Priority Data

Oct. 22, 2002 (DE) ..... 202 16 304 U
Aug. 8, 2003 (WO) ..... PCT/EP03/08842

(51) Int. Cl.

| | |
|---|---|
| ***E03C 1/084*** | (2006.01) |
| ***E03C 1/086*** | (2006.01) |
| ***E03C 1/08*** | (2006.01) |
| ***B05B 1/00*** | (2006.01) |
| ***B25B 13/56*** | (2006.01) |
| ***B25B 13/00*** | (2006.01) |
| ***B25B 23/00*** | (2006.01) |

(52) U.S. Cl. ..... 239/428.5; 239/391; 239/397; 239/580; 239/600; 81/124.2; 81/176.15; 81/461; 137/327

(58) Field of Classification Search ..... 239/225.1, 239/600, 428.5, 580, 397, 391, 390, 575, 239/DIG. 23, 590, 596; 81/176.1–176.15, 81/124.2, 461; 137/328, 327, 15.18, 15.08, 137/801

See application file for complete search history.

(56) References Cited

U.S. PATENT DOCUMENTS

| | | | | |
|---|---|---|---|---|
| 76,900 | A * | 4/1868 | Fisk | 81/74 |
| 541,651 | A * | 6/1895 | Baumgartner | 217/109 |
| 873,009 | A * | 12/1907 | Baxter | 411/427 |

(Continued)

*Primary Examiner*—Darren W Gorman
(74) *Attorney, Agent, or Firm*—Volpe And Koenig, P.C.

(57) ABSTRACT

A turning tool (5') for turning a jet regulator, a nozzle, an intermediate holder, a flow regulator, a non-return valve or a similar plumbing fitting (5) is provided. The fitting (5), on the outlet side, is detachably held on a plumbing water outlet armature (2) by a threaded connection or a bayonet connection, whereby the turning tool (5') can be placed on the plumbing fitting (5) in a rotationally fixed manner. The turning tool is characterized in that the turning tool is also provided in the form of a plumbing fitting or as a component of a plumbing fitting, that he turning tool (5') can be placed in a rotationally fixed manner on an outer or an inner periphery of the fitting (5) that is held on the water outlet armature, and or that he turning tool (5') has a face profiling or contouring (24, 25) that can be placed in a rotationally fixed manner on a mating profiling or a mating contouring (25, 24) provided on the outlet face of the fitting (5) that is held in the water outlet armature (2).

8 Claims, 1 Drawing Sheet

U.S. PATENT DOCUMENTS 874,543 A * 12/1907 Scheuer ..... 81/176.15
1,397,876 A * 11/1921 Meldal ..... 411/427
1,810,795 A * 6/1931 Soderquist ..... 81/3.48
3,768,345 A * 10/1973 Barnes ..... 81/176.15
3,827,636 A * 8/1974 Parkison et al. ..... 239/428.5
4,478,368 A * 10/1984 Yie ..... 239/430
4,533,005 A * 8/1985 Morris ..... 175/393
4,534,513 A * 8/1985 Aghnides ..... 239/428.5
4,534,514 A * 8/1985 Aghnides ..... 239/428.5
4,722,609 A 2/1988 Epstein et al.
4,776,412 A * 10/1988 Thompson ..... 175/393
4,905,547 A * 3/1990 Nigrelli ..... 81/176.15
5,216,941 A * 6/1993 Kolvereid ..... 81/461
5,337,958 A * 8/1994 Hennessy et al. ..... 239/71
5,456,289 A * 10/1995 Bergmann ..... 138/45
5,487,507 A * 1/1996 McDonald et al. ..... 239/391
5,769,326 A * 6/1998 Muchenberger et al. . 239/428.5
5,875,694 A * 3/1999 Graf ..... 81/461
6,029,756 A * 2/2000 Britzke et al. ..... 175/57
6,085,996 A * 7/2000 Culbertson et al. ..... 239/290
6,234,411 B1 * 5/2001 Walker et al. ..... 239/289
6,257,099 B1 * 7/2001 Rosenbaum ..... 81/124.4
6,470,506 B2 * 10/2002 Weber ..... 4/420.1
6,796,013 B2 * 9/2004 Melker et al. ..... 29/240
6,971,591 B2 * 12/2005 Fleischmann ..... 239/428.5
2002/0079471 A1 6/2002 Shen
2002/0129442 A1 * 9/2002 Weber ..... 4/420.1
2002/0185553 A1 * 12/2002 Benstead et al. ..... 239/428.5

* cited by examiner

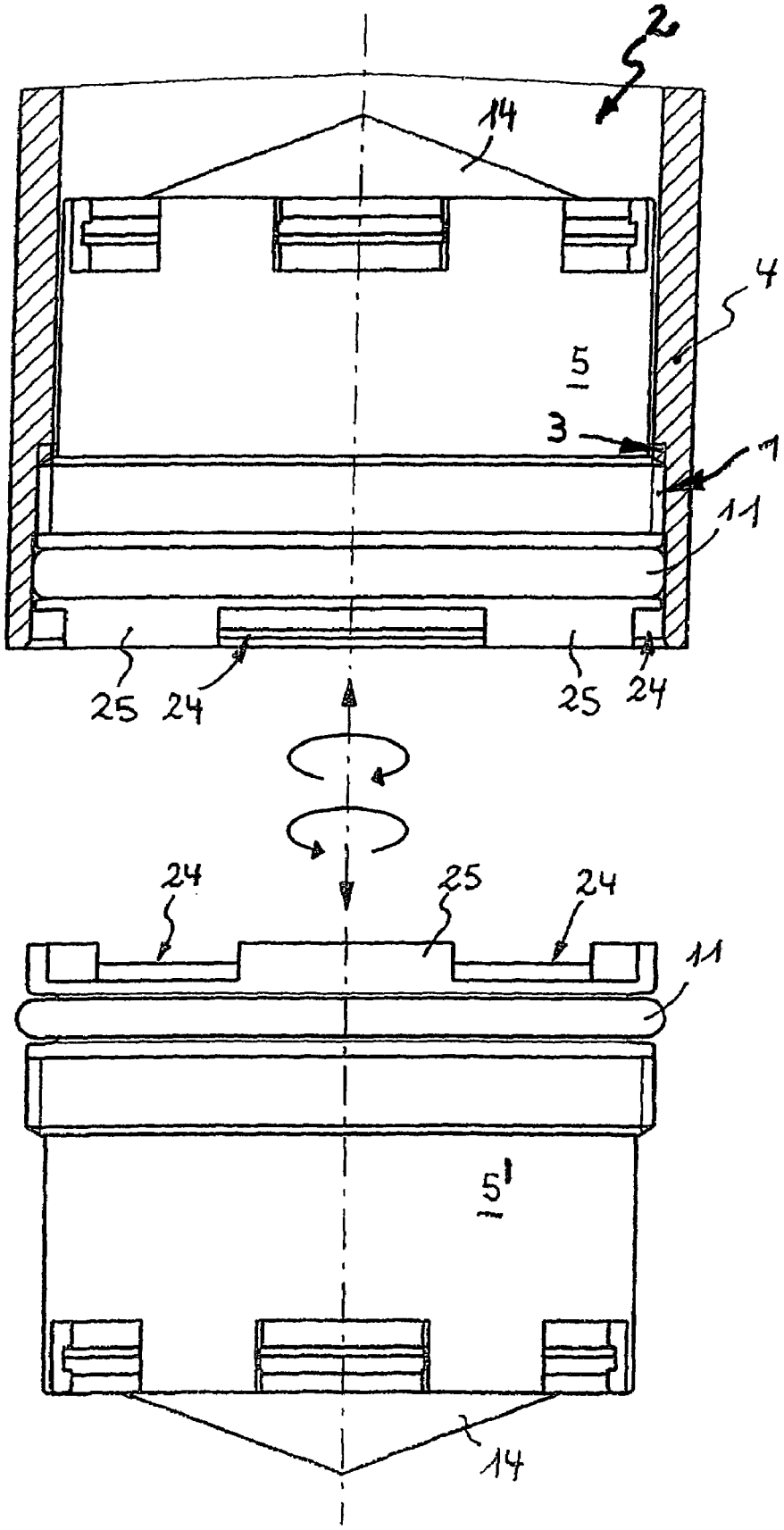
2
14
4
5
3
1
11
25
24
25
24
24
25
24
11
5'
14

TURNING TOOL FOR TURNING A PLUMBING FITTING

BACKGROUND

The invention relates to a turning tool for turning a jet regulator, a nozzle, an intermediate holder, a flow regulator, a non-return valve, or a similar plumbing fitting. This fitting, on the opening side, is detachably held on a plumbing water outlet armature by means of a screw connection or a bayonet connection, whereby the turning tool can be placed on the plumbing fitting in a rotationally fixed manner.

Typically, a nozzle, in which a jet regulator is inserted, is screwed onto the opening-side outlet end of plumbing outlet armatures. This jet regulator should transform the water stream flowing into the regulator into a homogeneously aerated, soft water jet. Such jet regulators must be disassembled and exchanged at time intervals of several years. For this purpose, in order to screw the nozzle off of the outlet armature and to be able to remove the jet regulator located in the nozzle from the nozzle, ring wrench-like turning tools have already been designed, which can be slid onto the nozzle from the opening side and can be set in a rotationally fixed manner in this position.

However, in an emergency this turning tool is usually not available for the user. Above all, the production and purchase of this turning tool is associated with an additional cost outlay.

SUMMARY

Therefore, the objective arises of creating a turning tool of the type named above, which helps to prevent the disadvantages of the known state of the art described above.

In the turning tool of the type named above, the solution of this objective according to the invention is provided in that the turning tool is embodied as a plumbing fitting or as a component of a plumbing fitting and that the turning tool can be placed in a rotationally fixed manner on the outer or inner periphery of the fitting held on the water outlet armature and/or that the turning tool has a face profiling or contouring, which can be placed in a rotationally fixed manner on the mating profiling or mating contouring provided on the outlet face of the fitting held on the water outlet armature.

According to the invention, the turning tool itself is formed as a plumbing fitting or at least as a component of such a plumbing fitting. Because the fitting used as the turning tool or the corresponding component is required anyway by the manufacturer or user, the production or creation of this turning tool is not associated with significant additional costs. In order to be able to place the turning tool for turning on the fitting located on the water outlet armature in a rotationally fixed manner, the fitting or the corresponding component used as the turning tool can feature on its inlet or outlet face a profiling or contouring, which can be placed in a rotationally fixed manner on a mating profiling or mating contouring provided on the outlet face of the fitting held on the water outlet armature. With the help of this turning tool, the screw connection or the bayonet or similar catch can then be disengaged, which, up until then, had held the fitting on the water outlet armature.

However, as an additional or alternative characteristic, the turning tool can also be placed in a rotationally fixed manner on the outer or inner periphery of the fitting held on the water outlet armature.

In this way, one simple and advantageous embodiment according to the invention provides that the turning tool and the fitting held detachably on the water outlet armature have outer contours adapted to each other at least in sections such that these can be placed in each other in this region and can be connected to each other in a rotationally fixed manner. Thus, the turning tool on one hand and the fitting located on the water outlet armature on the other hand can have outer or inner contours adapted to the face regions that can be placed one on the other.

In this way, one embodiment according to the invention provides that the fitting held on the water outlet armature, at least in its opening-side face region, has an outer outline or a clear inner opening, which conforms in shape to the clear inner opening or to the outer outline of the turning tool, such that these parts can be inserted into each other in this region in a rotationally fixed manner.

However, it is also possible that the turning tool or the fitting held on the water outlet armature has on its inner periphery at least in sections a contouring or profiling, which can be placed on a mating profiling or mating contouring in a rotationally fixed manner when the other corresponding part is inserted in this position.

So that the turning tool can be placed particularly securely and tightly on the outer or inner periphery of the fitting on the water outlet armature, it is advantageous if the turning tool is provided in the shape of a collar and formed as a nozzle, an intermediate holder, or a housing of a plumbing fitting.

In certain applications, it can be necessary to exchange an aerated jet regulator with a non-aerated jet regulator or to replace a flow limiter with a flow regulator. In such individual cases, the fitting or the corresponding component used as a turning tool on one hand and the fitting on the water outlet armature on the other hand can be different in shape and function. However, one preferred refinement according to the invention provides that the turning tool is at least a component of a fitting that is identical in function and/or shape to the fitting held on the water outlet armature. Thus, for example, a collar-shaped housing, which is identical in shape to the housing of the fitting located on the water outlet armature, can be used as the turning tool. Such a housing will be produced in large quantities, so that as a precaution, a housing acting as a turning tool can also be added to each fitting defined for the initial outfitting, without this being associated with special additional costs for the manufacturer or the user.

One preferred embodiment according to the invention provides that the profilings or contourings provided on the faces on the turning tool on one hand and on the fitting held on the water outlet armature on the other hand are formed in the shape of a crown.

In this way, in order to simplify the identically shaped construction of the fittings and their components, it is useful if the profilings or contourings provided on the turning tool on one hand and the fitting held detachably on the water outlet armature on the other hand are provided on the outlet face of these parts.

The turning tool according to the invention can be used in large quantities especially where the turning tool on one hand and the fitting held detachably on the water outlet armature on the other hand are each constructed as a jet regulator or at least as a component of a jet regulator.

Additional features of the invention emerge from the following description of an embodiment according to the invention in connection with the claims, as well as the drawing. The present invention will be explained in more detail with reference to the following embodiment.

BRIEF DESCRIPTION OF THE DRAWING

In the single FIGURE, a plumbing water outlet armature 2 is shown in the region of its outlet end 4. A plumbing fitting 5, which here is constructed as a jet regulator and which has a sieve attachment 14 on the inflow side, is screwed into the water outlet armature 2 from the opening side. On the outer peripheral side, above an annular seal 11, an outer threading 1, which can be screwed into an internal threading 3 on the inner periphery of the water outlet armature 2, is provided on the housing of the fitting 5.

DETAILED DESCRIPTION OF THE PREFERRED EMBODIMENT

In order to be able to turn, when necessary, the fitting 5 that is held detachably on the water outlet armature 2 and that can be screwed practically completely into the water outlet armature 2 and in order to be able to disengage this fitting from its screw connection in the water outlet armature 2, a turning tool is necessary, which is constructed according to the invention also as a plumbing fitting 5' or at least as a component of a plumbing fitting.

In this way, the fitting 5', which is used as the turning tool and which also is identical in function to that of the jet regulator, and the fitting 5 located in the water outlet armature 2 are identical in shape.

On the outlet faces of their housings, the fittings 5, 5' have face profiling and mating profiling, respectively. These profilings and mating profilings are formed by the corresponding, crown-shaped face of the fitting housing, with the recesses 24 and projections 25 of one part 5, 5' provided on the crown-shaped face engaging in the projections 25 and recesses 24 of the corresponding other part 5', 5.

In the embodiment shown here, the fitting 5 located in the water outlet armature 2 can be unscrewed with the help of the fitting 5' intended for replacement and here identical in shape and function. The fitting 5' also acting as a jet regulator is then screwed into the water outlet armature with the help of the disassembled fitting 5. Thus, while here a complete fitting 5' is used for replacing the fitting 5 located in the water outlet armature 2, it is nevertheless also possible to use only the housing of an otherwise not included fitting for unscrewing the fitting 5 located in the outlet armature. For this purpose, the fixture manufacturer can supply only one additional housing with the fixture, with this housing being intended as the turning tool. This has the advantage that the fixture manufacturer does not have to supply a second functional unit, which can be mounted in the water outlet armature 2, and the other housing, which is intended as a turning tool and which is produced and used in relatively large quantities, represents a very economical aid.

The invention claimed is:

1. An aerator turning tool (5'), for turning a jet regulator, a nozzle, an intermediate holder, a flow regulator, a non-return valve, or a similar plumbing fitting (5), wherein the fitting (5), at an opening side, is held detachably in a plumbing water outlet armature (2) by a screw connection or bayonet connection, wherein the aerator turning tool (5') is constructed with a collar shape and is formed as a nozzle, an intermediate holder, or a housing of the plumbing fitting and is placed in a rotationally fixed manner on the plumbing fitting (5) held in the water outlet armature (2) the aerator turning tool (5') has a profiling (24, 25) or contouring on an end face side, which is placed in a rotationally fixed manner on a mating profiling or mating contouring (25, 24) provided on an outlet end face of the fitting (5) held in the water outlet armature (2).

2. The aerator turning tool according to claim 1, wherein the aerator turning tool (5') and the fitting (5) held detachably in the water outlet armature (2) have outer contours adapted to each other at least in sections, such that the aerator turning tool and the fitting (5', 5) can be inserted one in one another in the sections and can be connected to each other in a rotationally fixed manner.

3. The aerator turning tool according to claim 1, wherein at least in an opening-side face region thereof, the fitting (5) held in the water outlet armature (2) has an outer outline or a clear inner opening, which is adapted in shape to a clear inner opening or to an outer outline of the aerator turning tool (5'), such that the fitting and the aerator turning tool (5', 5) can be inserted one in the other in this region in a rotationally fixed manner.

4. The aerator turning tool according to claim 1, wherein the aerator turning tool (5') or the fitting held in the water outlet armature (2) has on an inner periphery thereof, at least in sections, a contouring or profiling, which is placed in a rotationally fixed manner on a mating profiling or mating contouring when the other of the fitting and the aerator turning tool is inserted therein.

5. An aerator turning tool (5'), for turning a jet regulator, a nozzle, an intermediate holder, a flow regulator, a non-return valve, or a similar plumbing fitting (5), wherein the fitting (5), at an opening side, is held detachably in a plumbing water outlet armature (2) by a screw connection or bayonet connection, the aerator turning tool (5') is placed in a rotationally fixed manner on the plumbing fitting (5) held in the water outlet armature (2) the aerator turning tool (5') has a profiling (24, 25) or contouring on an end face side, which is placed in a rotationally fixed manner on a mating profiling or mating contouring (25, 24) provided on an outlet end face of the fitting (5) held in the water outlet armature (2), wherein the aerator turning tool (5') is at least a component of a fitting that is identical in function and/or shape to the fitting (5) held in the water outlet armature.

6. The aerator turning tool according to claim 1, wherein the profilings (24, 25) or contourings that are provided on the end face side on the aerator turning tool (5') on one hand and on the fitting (5) held detachably in the water outlet armature (2) on the other hand and that is placed one in the other in a rotationally fixed manner are constructed in a crown shape.

7. The aerator turning tool according to claim 1, wherein the profilings (24, 25) or contourings provided on the aerator turning tool (5') on one hand and on the fitting (5) held detachably in the water outlet armature (2) on the other hand are each provided on the end face side of the aerator turning tool and outlet face side of the fixture (5', 5).

8. An aerator turning tool (5'), for turning a jet regulator, a nozzle, an intermediate holder, a flow regulator, a non-return valve, or a similar plumbing fitting (5), wherein the fitting (5), at an opening side, is held detachably in a plumbing water outlet armature (2) by a screw connection or bayonet connection, the aerator turning tool (5') is placed in a rotationally fixed manner on the plumbing fitting (5) held in the water outlet armature (2) the aerator turning tool (5') has a profiling (24, 25) or contouring on an end face side, which is placed in a rotationally fixed manner on a mating profiling or mating contouring (25, 24) provided on an outlet end face of the fitting (5) held in the water outlet armature (2), wherein the aerator turning tool (5') on one hand and the fitting (5) held detachably in the water outlet armature (2) on the other hand are each constructed as a jet regulator or at least as a component of a jet regulator.

* * * * *